US009434395B2

(12) United States Patent
Goding et al.

(10) Patent No.: US 9,434,395 B2
(45) Date of Patent: Sep. 6, 2016

(54) FABRICATED FRAME FOR RAILWAY TRUCK

(71) Applicant: Electro-Motive Diesel, Inc., Lagrange, IL (US)

(72) Inventors: David J. Goding, Palos Park, IL (US); Wojciech Rulewicz, Lisle, IL (US)

(73) Assignee: Electro-Motive Diesel, Inc., La Grange, IL (US)

( * ) Notice: Subject to any disclaimer, the term of this patent is extended or adjusted under 35 U.S.C. 154(b) by 203 days.

(21) Appl. No.: 13/929,399

(22) Filed: Jun. 27, 2013

(65) Prior Publication Data

US 2015/0000551 A1 Jan. 1, 2015

(51) Int. Cl.

| | |
|---|---|
| ***B61F 5/52*** | (2006.01) |
| ***B61C 5/00*** | (2006.01) |
| ***B61F 3/06*** | (2006.01) |

(52) U.S. Cl.

CPC . *B61F 5/52* (2013.01); *B61C 5/00* (2013.01); *B61F 3/06* (2013.01)

(58) Field of Classification Search

CPC ..... B61F 5/36; B61F 3/06; B61F 5/52; B61F 5/30; B61F 5/48; B61F 5/301; B61C 3/00; B61C 5/00

USPC ..... 105/206.1, 206.2, 453, 224.05, 224.06

See application file for complete search history.

(56) References Cited

U.S. PATENT DOCUMENTS

| | | | | |
|---|---|---|---|---|
| 2,132,387 | A * | 10/1938 | Barrows | 105/224.05 |
| 2,267,589 | A * | 12/1941 | Eksergian | 105/198 |
| 2,719,491 | A | 10/1955 | Erzer | |
| 4,485,743 | A | 12/1984 | Roush et al. | |
| 4,628,824 | A | 12/1986 | Goding et al. | |
| 4,679,506 | A | 7/1987 | Goding et al. | |
| 4,679,507 | A | 7/1987 | Rassaian | |
| 4,765,250 | A | 8/1988 | Goding | |
| 4,841,873 | A | 6/1989 | Goding et al. | |
| 5,085,151 | A * | 2/1992 | Wako et al. | 105/206.1 |
| 5,263,420 | A * | 11/1993 | Schwendt et al. | 105/166 |

(Continued)

FOREIGN PATENT DOCUMENTS

| | | |
|---|---|---|
| CN | 202413829 | 9/2012 |
| DE | 19506586 | 8/1996 |

(Continued)

OTHER PUBLICATIONS

U.S. Appl. No. 13/409,079 entitled "Frame for Railway Truck" filed Feb. 29, 2012.

(Continued)

*Primary Examiner* — Mark Le

(74) *Attorney, Agent, or Firm* — Finnegan, Henderson, Farabow, Garrett & Dunner, LLP

(57) ABSTRACT

A frame for use with a railway truck having a plurality of support springs is provided. The frame may have a bottom section with a plurality of first openings configured to receive the plurality of support springs, and a middle section welded to the bottom section. The frame may also have a top section spaced apart from the bottom section and welded to the middle section. The top section may have a plurality of second openings configured to register with the plurality of first openings in the bottom section, and a plurality of protrusions extending away from the middle section at the plurality of second openings to enclose exposed ends of the plurality of support springs.

18 Claims, 5 Drawing Sheets

(56) References Cited

U.S. PATENT DOCUMENTS

| | | | | |
|---|---|---|---|---|
| 5,613,444 | A | 3/1997 | Ahmadian et al. | |
| 5,746,135 | A | 5/1998 | Ahmadian et al. | |
| 6,871,598 | B2 | 3/2005 | Schaller et al. | |
| 2005/0183625 | A1 | 8/2005 | Goding et al. | |
| 2006/0065153 | A1 | 3/2006 | Watanabe et al. | |
| 2009/0031918 | A1* | 2/2009 | Hewitt et al. | 105/198.2 |
| 2011/0221159 | A1 | 9/2011 | Gorski et al. | |
| 2012/0159883 | A1* | 6/2012 | Dayton | 52/309.1 |

FOREIGN PATENT DOCUMENTS

| | | |
|---|---|---|
| GB | 403906 | 7/1933 |
| JP | 2000-085579 | 3/2000 |
| JP | 2001080512 | 3/2001 |
| JP | 2001-233208 | 8/2001 |
| JP | 4442518 | 3/2010 |
| JP | 2012-046069 | 3/2012 |

OTHER PUBLICATIONS http://www.railroadforums.com/photos/data/589/1123_731_nova_granja_03jun2005.jpg (prior to Feb. 21, 2012).
http://www.railpictures.net/images/d1/2/4/3/8243.1296750113.jpg (prior to Feb. 21, 2012).
http://sa-railnews.blogspot.com/2011/02/transnet-new-ge-c30acl-locomotives.html.
U.S. Appl. No. 13/409,079 entitled "Frame for Railway Truck" filed on Feb. 29, 2012.

* cited by examiner

FABRICATED FRAME FOR RAILWAY TRUCK

TECHNICAL FIELD

The present disclosure relates generally to a frame and, more particularly, to a fabricated frame for a railway truck.

BACKGROUND

Locomotives traditionally include a car body that houses one or more power units of the locomotive. The weight of the car body is supported at either end by trucks that transfer the weight to opposing rails. The trucks typically include cast steel frames that provide a mounting for traction motors, axles, and wheel sets. Locomotives can be equipped with trucks having two, three, or four axles. Although suitable for many applications, cast truck frames can be expensive, especially when produced in low numbers for specialized applications.

An exemplary fabricated locomotive truck is disclosed in JP Patent No. 2000085579A of Hitachi Ltd. that published on Mar. 28, 2000 ("the '579 patent"). Specifically, the '579 patent discloses a frame fabricated by welding a cast upper plate to a cast lower plate, such that integral U-shaped grooves are created at cross-sections of the frame. Cylindrical protrusions are formed at the lower plate and press-fitted into holes in the upper plate. Ends of the cylindrical protrusions are welded to edges of the holes, and seats are inserted into the cylindrical holes of the top plate. Springs, which ride on an axle bearing housing, extend into the cylindrical protrusions to suspend the frame above the associated axles.

Although perhaps suitable for some applications, the frame of the '579 patent may be less than optimal. In particular, because the springs push against the seats at the top plate, the length of the springs usable with the frame may be limited in length by the location of the top plate. In addition, the '579 patent does not disclose a way to limit separation of the bearing housing from the frame or to limit transverse movement of the frame. Further, separating the frame into two cast components may not significantly lower a production cost of the frame.

The frame of the present disclosure solves one or more of the problems set forth above and/or other problems in the art.

SUMMARY

In one aspect, the present disclosure is related to a frame for a railway truck having a plurality of support springs. The frame may include a bottom section with a plurality of first openings configured to receive the plurality of support springs, and a middle section welded to the bottom section. The frame may also include a top section spaced apart from the bottom section and welded to the middle section. The top section may have a plurality of second openings configured to register with the plurality of first openings in the bottom section, and a plurality of protrusions extending away from the middle section at the plurality of second openings to enclose exposed ends of the plurality of support springs.

In another aspect, the present disclosure is related to another frame for a railway truck having a plurality of support springs. This frame may include a generally planar bottom section having a plurality of elongated openings configured to receive the plurality of support springs, and a middle section welded to the generally planar bottom section. The frame may also include a top section spaced apart from the generally planar bottom section and welded to the middle section. The top section may have a plurality of circular openings configured to register with the plurality of elongated openings in the generally planar bottom section, and a plurality of protrusions extending away from the middle section at the plurality of circular openings to enclose exposed ends of the plurality of support springs.

In another aspect, the present disclosure is related to a railway truck. The railway truck may include a plurality of axles, a plurality of wheels connected to ends of the plurality of axles, and a plurality of traction motors configured to drive the plurality of wheels. The railway truck may also include a bearing assembly located at each end of each of the plurality of axles, two springs supported by each bearing assembly, and a frame spaced apart from the plurality of axles by the springs and configured to support the plurality of traction motors. The frame may include a bottom section having two elongated and generally planar side members with elongated openings each configured to receive the two springs at each of the plurality of axles, and a middle section welded on top of the bottom section. The frame may also include a top section welded on top of the middle section to form a plurality of hollow enclosures within the middle section. The top section may have a plurality of side members each with a plurality of circular openings configured to register with the plurality of elongated openings. Each of the plurality of circular openings may be configured to receive one of the two support springs. The top section may also have a plurality of protrusions welded to upper surfaces of the plurality of side members and configured to enclose the two support springs.

DETAILED DESCRIPTION

Figure 1:
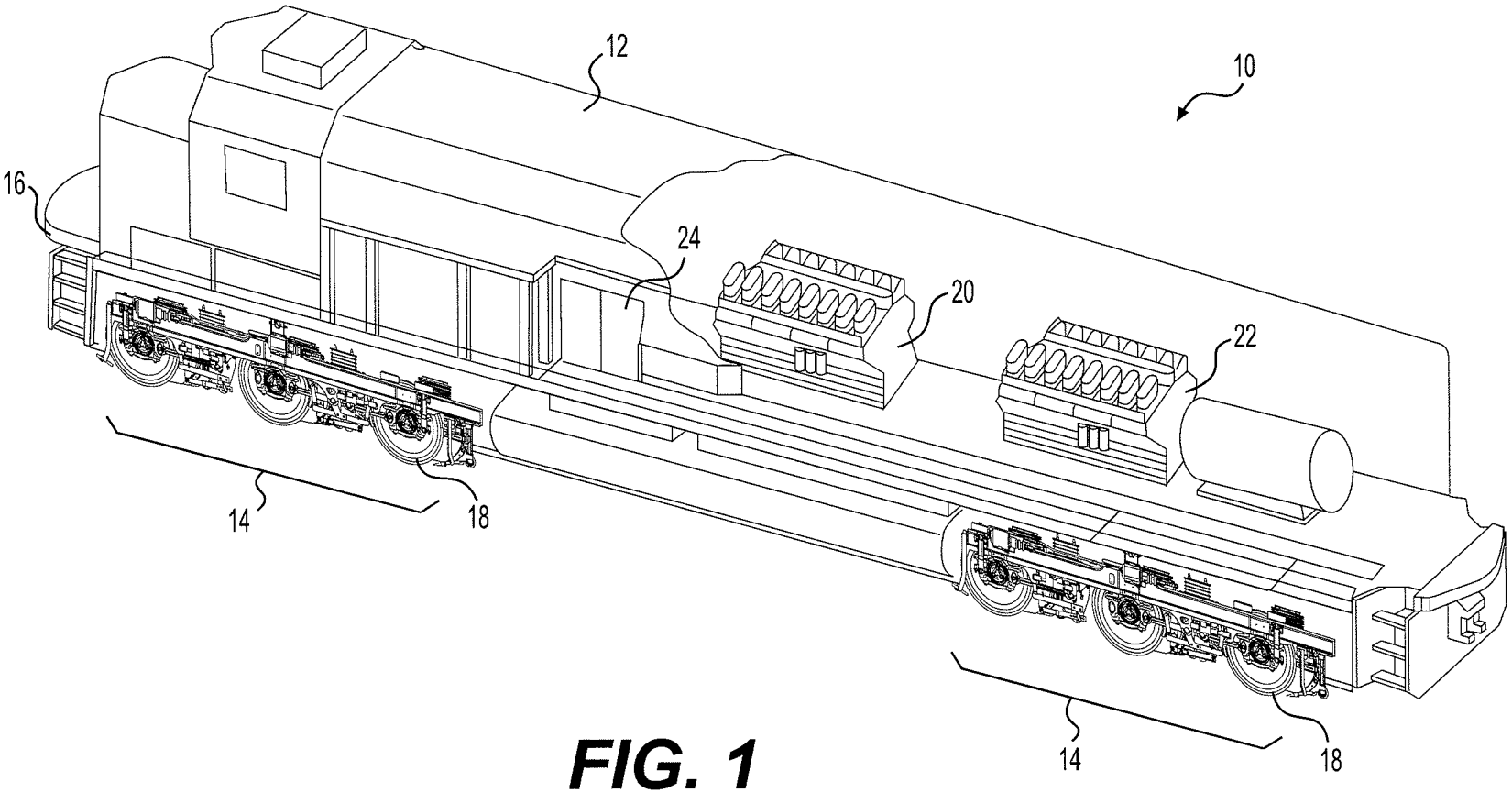
FIG. 1 is an isometric view illustration of an exemplary disclosed locomotive.

FIG. 1 illustrates an exemplary locomotive 10 that includes a car body 12 supported at opposing ends by a plurality of trucks 14 (e.g., two trucks 14). Each truck 14 may be configured to engage a track (not shown) and support a base platform 16 of car body 12. Any number of engines may be mounted to base platform 16 and configured to drive a plurality of wheels 18 included within each truck 14. In the exemplary embodiment shown in FIG. 1, locomotive 10 includes a first engine 20 and a second engine 22 that are lengthwise aligned on base platform 16 in a travel direction of locomotive 10. One skilled in the art will recognize, however, that first and second engines 20, 22 may be arranged transversally or in any other orientation on base platform 16.

Car body 12 may be fixedly or removably connected to base platform 16 to substantially enclose first and second engines 20, 22, while still providing service access to first and second engines 20, 22. For example, car body 12 may be welded to base platform 16 and include one or more access doors 24 strategically located in the vicinity of first and second engines 20, 22. Alternatively, car body 12 may be attached to base platform 16 by way of fasteners such that portions or all of car body 12 may be completely removed from base platform 16 to provide the necessary access to first and second engines 20, 22. It is contemplated that car body 12 may alternatively be connected to base platform 16 in another manner, if desired.

Figure 2:
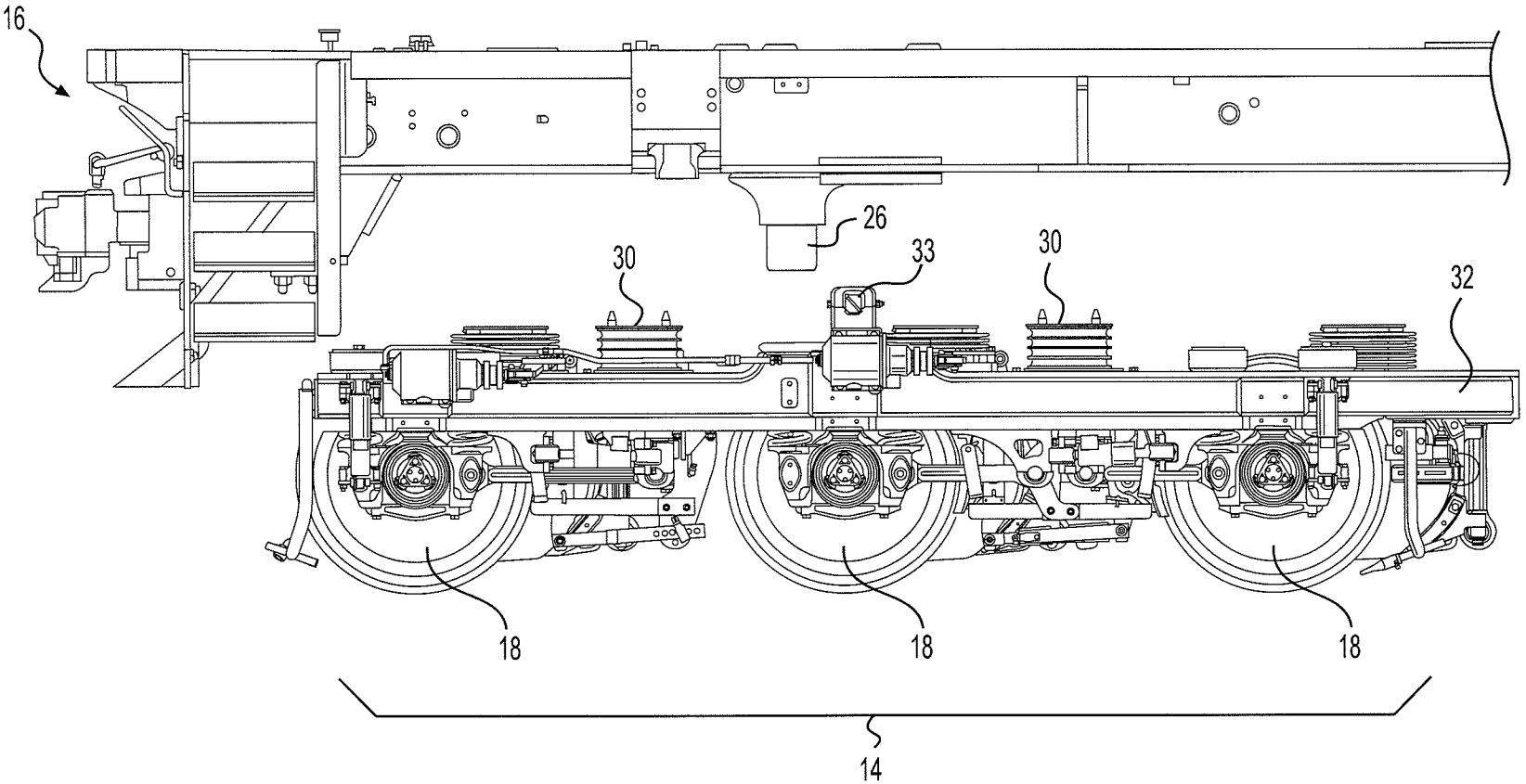
FIG. 2 is a semi-exploded view illustration of an exemplary disclosed truck and base platform that may be used in conjunction with the locomotive of FIG. 1.

Base platform 16 may be configured to pivot somewhat relative to trucks 14 during travel of locomotive 10 along a curving track trajectory. As shown in FIG. 2, base platform 16 may be provided with a pivot shaft 26 at each end (only one end shown in FIG. 2) that extends downward from a transverse center to engage a bearing 28 (shown only in FIG. 3) located at a general center of each truck 14. Pivot shaft 26 may be designed to transmit tractive forces (i.e., forces in a fore/aft direction, including propelling and braking forces) forces between car body 12 and trucks 14, with minimal transmission of vertical forces (i.e., the weight of locomotive 10) and lateral (i.e., side-to-side) forces.

Trucks 14 may be spaced apart from base platform 16 by way of a plurality of resilient members (RMs) 30 located in pairs in general fore/aft alignment with each other at the sides of base platform 16. RMs 30 may be sandwiched between a frame 32 of truck 14 and an underside of base platform 16. In the disclosed embodiment, each RM 30 includes a rubber compression pad that is removably connected to frame 32 and pinned to base platform 16, although other configurations of RM 30 may also be utilized. RM 30 may be configured to undergo a shearing motion during pivoting or lateral motion of base platform 16 relative to truck 14. One or more limiters 33 may be rigidly connected to opposing sides of each truck 14 and configured to vertically retain truck 14 in location relative to base platform 16 and/or to limit a maximum amount of relative pivoting between truck 14 and base platform 16 (i.e., to limit a maximum shearing of RM 30). RM 30 may be configured to transmit vertical forces between car body 12 and trucks 14, with minimal transmission of tractive forces.

Figure 3:
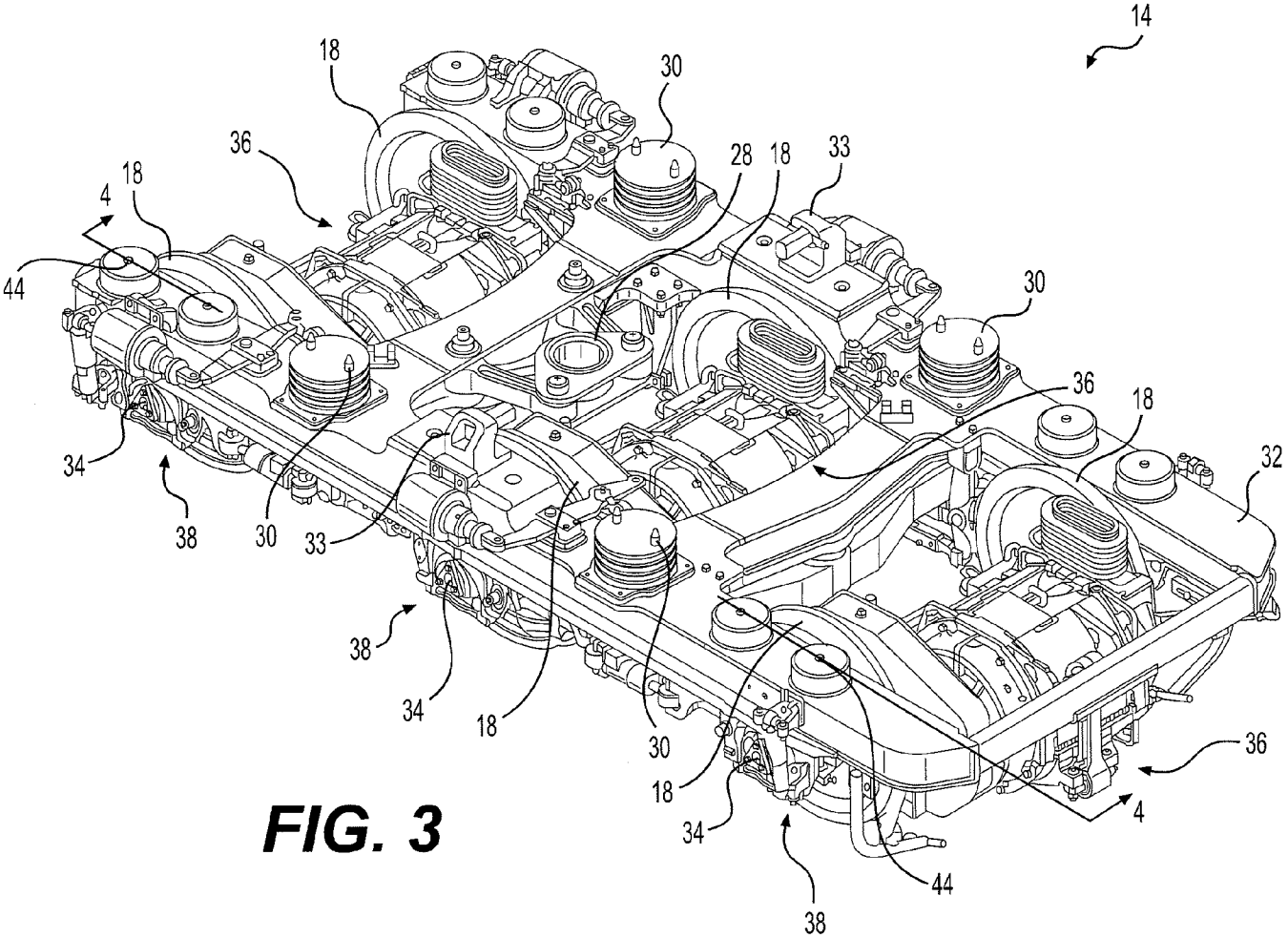
FIG. 3 is an isometric view illustration of the truck of FIG. 2.
Figure 4:
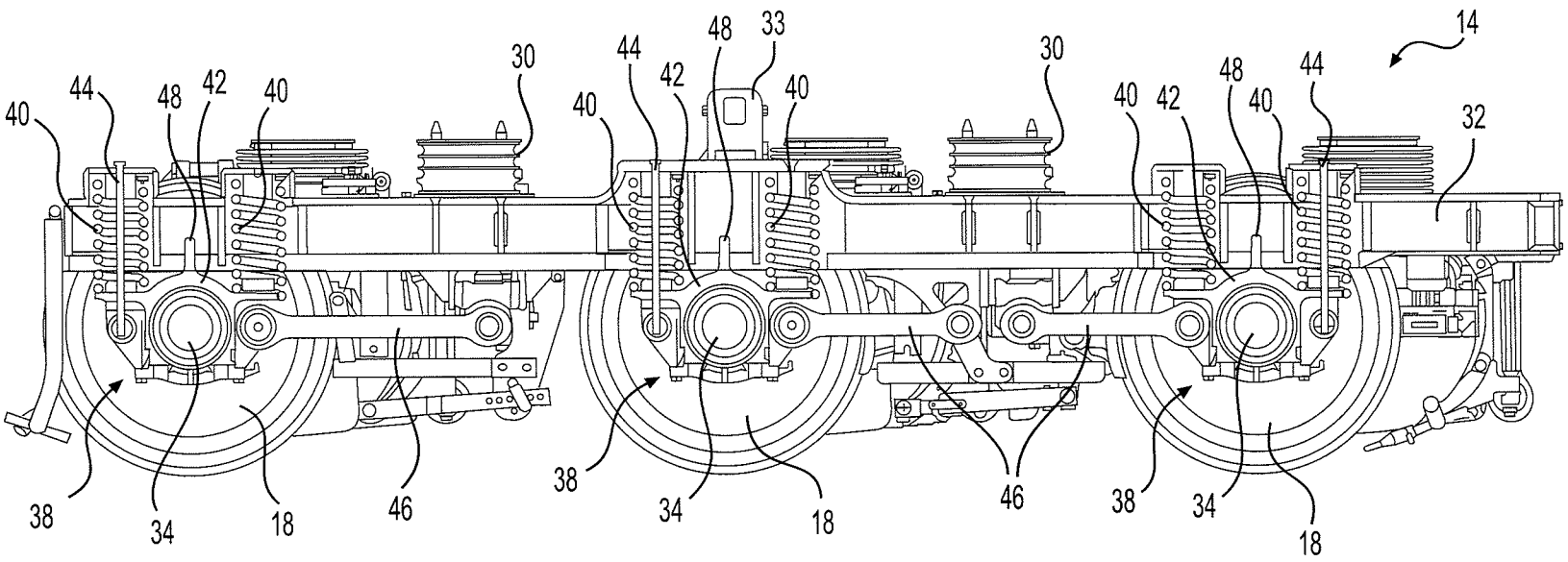
FIG. 4 is a cutaway view illustration of the truck of FIGS. 2 and 3.

An exemplary embodiment of truck 14 is shown in FIGS. 3 and 4. It should be noted that all trucks 14 within locomotive 10 may be substantially identical. As can be seen in these figures, each truck 14 may be an assembly of components that together transfers lateral, tractive, and vertical forces between car body 12 (referring to FIG. 1) and the associated tracks. For example, each truck 14 may include, among other things, wheels 18, a plurality of axles 34 connected between opposing wheels 18, and frame 32 connected to and configured to help distribute loads between axles 34.

Two wheels 18 may be rigidly connected at the opposing ends of each axle 34, such that wheels 18 and axles 34 rotate together. A traction motor 36, for example an electric motor driven with power generated by first and/or second engines 20, 22 (referring to FIG. 1), may be disposed at a lengthwise center of each axle 34, connected to frame 32, and configured to drive paired wheels 18 via axles 34. The opposing ends of axles 34 may be held within separate bearing assemblies 38, which may be configured to transfer forces (i.e., lateral, tractive, and vertical forces) from wheels 18 to the remaining components of truck 14. Two springs 40 (e.g., for example axle-mounted coil springs) may be configured to vertically support and cushion frame 32 relative to wheels 18 at each axle 34. In the disclosed embodiment, springs 40 rest on a pedestal housing 42 of bearing assembly 38, at either side of axle 34, and at least partially housed within frame 32 (side members of frame 32 are removed in FIG. 4 for clarity). A vertical motion limiter 44 may be associated with one or both of springs 40 (e.g., disposed within one of springs 40) at each end of axle 34 and configured to limit a separation distance between frame 32 and the associated axle 34. Pedestal housing 42 may be restrained in a tractive direction relative to frame 32 via a horizontal traction rod 46, and laterally restrained via protrusions 48 that extend upward from each pedestal housing 42 past the sides of frame 32.

Figure 5:
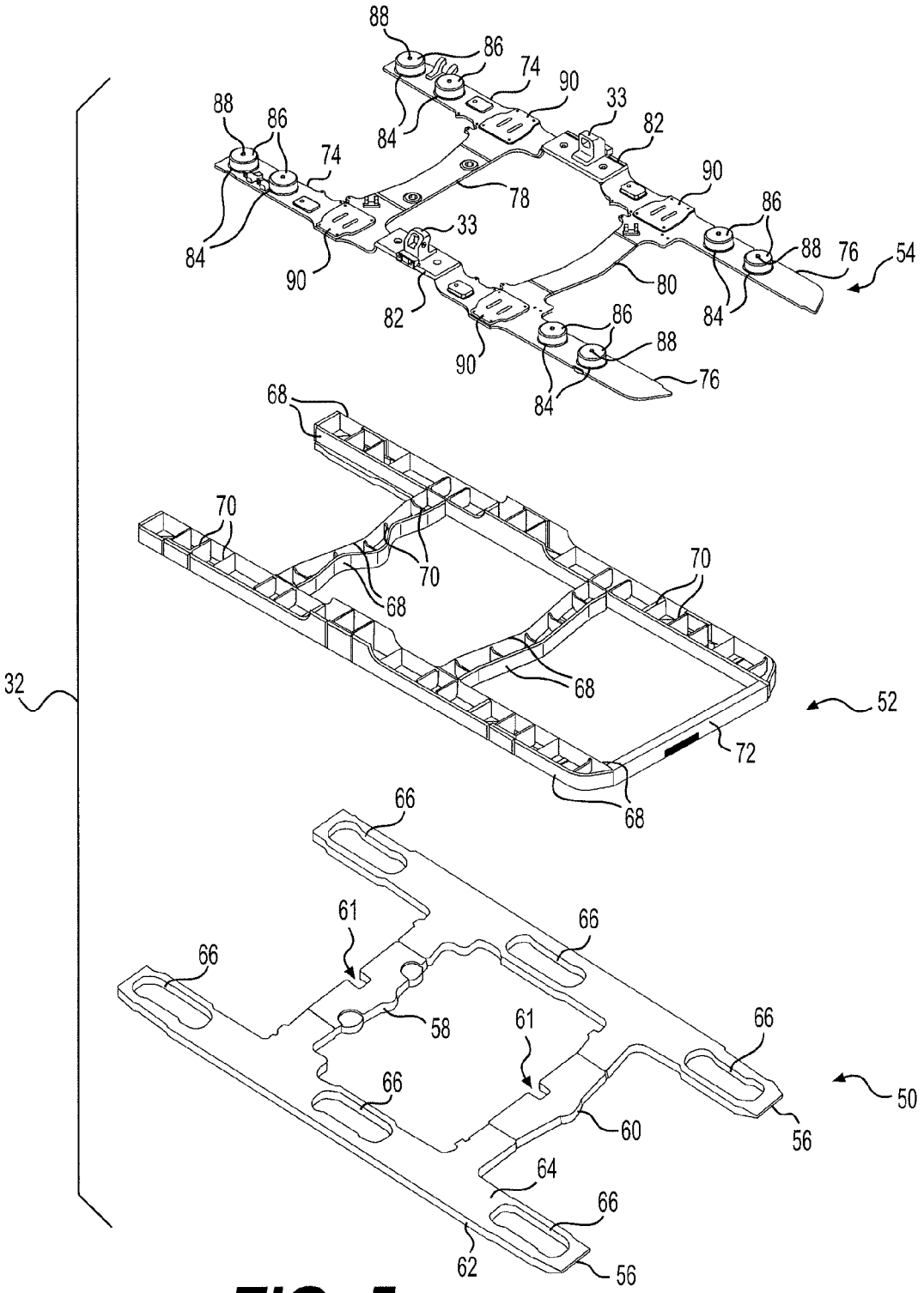
FIG. 5 is an exploded view illustration of an exemplary disclosed frame that may be used in conjunction with the truck of FIGS. 2-4.

FIG. 5 illustrates an exemplary embodiment of frame 32. As can be seen in this figure, frame 32 may be a fabrication of several different sections each including multiple components. In particular, frame 32 may be a fabrication of a bottom section 50 oriented toward associated tracks, a middle section 52, and a top section 54 oriented toward base platform 16. As will be described in more detail below, each of these sections may be welded together in a particular order to form frame 32.

Bottom section 50 may be generally plate-like and fabricated from two opposing side members 56, a leading transom 58, and a trailing transom 60. In one embodiment, side members 56 are cut from flat sheet stock having a generally consistent thickness, while leading and trailing transoms 58, 60 are cast components. In another embodiment, all components of bottom section 50 are cut from flat sheet stock. In a yet another embodiment, two or more of the components of bottom section 50 are integrally formed as a single component. After each component of bottom section 50 is cut and/or cast, the components may be welded to each other in the generally planar and ladder-like configuration shown in FIG. 5. It is contemplated that some surfaces of these components (e.g., surfaces of cast components associated with support arms of bearing 28—referring to FIG. 3) may be machined, if desired, before or after being joined together.

Side members 56 may each have a generally planar outer surface 62 and a generally planar inner surface 64 that is parallel with outer surface 62. Side members 56 may be elongated, and include multiple elongated or elliptically-shaped openings 66 formed along their lengths at locations corresponding to the intended positions of axles 34. Opposing ends of opening 66 may each be configured to receive one of springs 40, while a middle portion of each opening 66 may be configured to receive protrusion 48 of an associated pedestal housing 42. In some embodiments, side members 56 may bulge inward at openings 66 to provide additional material that increases a strength of side members 56. Side members 56 may extend inward towards each other at two spaced apart locations to join with leading and trailing transoms 58, 60. Leading and trailing transoms 58, 60 may each include a notch 61 that is configured to receive a mounting arm of a corresponding traction motor 36.

Once the components of bottom section 50 are welded together, bottom section 50 may function as a staging platform for fabrication of middle section 52. In particular, the different individual components of middle section 52 may be laid out at designated locations on bottom section 50, and then welded to each other and to bottom section 50. In some embodiments, one or more jigs (not shown) and/or projected images may be used to correctly position the components of middle section 52. The components of middle section 52 may include, among other things, a plurality of outer walls 68, and a plurality of webs 70 that extend between adjacent outer walls 68. A bottom edge of all of outer walls 68 and webs 70 may contact upper surfaces of bottom section 50, while a top edge of all outer walls 68 and webs 70 may contact bottom surfaces of top section 50. The connection of middle section 52 between bottom and top sections 50, 54 may form a plurality of separate and hollow enclosures that provide the required strength to frame 32, while maintaining a low assembly weight. A cross-tube 72 may extend between trailing ends of middle section 52 for added rigidity and to provide structural support for the mounting arm of a corresponding traction motors 36.

The general shape of top section 54 may substantially match the general shape of bottom section 50. Specifically, top section 54 may be generally planar and fabricated from two leading side members 74, two trailing side members 76, a leading transom 78, a trailing transom 80, and two center spring supports 82. In one embodiment, side members 74, 76 are cut from flat sheet stock having a generally consistent thickness, while leading transom 78, trailing transoms 80, and center spring supports 82 are cast components. In another embodiment, all components of top section 54 are cut from flat sheet stock. In a further embodiment, two or more of the components of top section 54 are integrally formed as a single component. After each component of top section 54 is cut and/or cast, the components may be welded to each other and to the top edges of outer walls 68 and webs 70. It is contemplated that some surfaces of these components (e.g., surfaces of cast components associated with support arms of bearing 28—referring to FIG. 3) may be machined, if desired, before or after being joined together. The flat, layered profile of top section 54 may help reduce packaging difficulties, help reduce part numbers and cost, and help increase a strength of frame 32.

Side members 74, 76 may each be generally planar along a majority length thereof, but curve upwards away from middle section 52 at interior ends to join center spring supports 82. Side members 74, 76 may be elongated, and include multiple separate circular openings 84 formed along their lengths at locations corresponding to the intended positions of axles 34. Each opening 84 may be configured to register with an end of openings 66 of bottom section 50 and to receive one of springs 40. A tubular protrusion 86 having a single closed end may be welded at each opening 84 to enclose exposed ends of the corresponding spring 40 (i.e., to enclose ends of spring 40 that extend out through openings 84). In some embodiments, a connection feature 88 (e.g., a bore) may be formed within the closed end of tubular protrusions 86 to receive a portion of a corresponding vertical motion limiter 44 (referring to FIG. 4). Side members 74, 76 may extend inward towards each other, respectively, at a single location to join with leading and trailing transoms 78, 80. Mounting pads 90 may be formed adjacent the extending areas, and configured to receive RMs 30. Leading and trailing transoms 78, 80 may be substantially identical to (e.g., mirror images of) leading and trailing transoms 58, 60 of bottom section 50.

Center spring supports 82 may be used for multiple different purposes. For example, center spring supports 82 may function in a similar manner as tubular protrusions 86. That is, each center spring support 82 may be a box-like protrusion that houses both springs 40 located at a lengthwise center axle 34 of truck 14. Center spring supports 82 may also provide a mounting platform for motion limiter 33. It is contemplated that center spring supports 82 may be replaced by additional tubular protrusions 86 and that motion limit 33 may alternatively be connected directly to flat upper surfaces of side members 74, 76, if desired.

It is contemplated that frame 32 may include additional features associated with auxiliary components. For example, frame 32 could include one or more brackets and/or mounting plates configured to receive braking components, to accommodate motors 36, to hang conduits or wiring, to support cooling ducts, etc. Although some of these additional features may be depicted in FIGS. 1-5, these features will not be described in detail in this disclosure.

INDUSTRIAL APPLICABILITY

The disclosed railway truck may provide a low-cost means for transferring tractive, transverse, and vertical forces between the wheels and the car body of a locomotive. This reduction of cost may improve applicability of the disclosed truck to low-volume applications and/or to situations where casting is not available or otherwise is cost prohibitive. The transfer of forces between wheels 18 and car body 12 will now be described in detail.

During operation of locomotive 10, motors 36 may be powered by engines 20, 22 to exert torque on wheels 18 via axles 34, thereby driving wheels 18 to propel locomotive 10. Reactionary forces associated with the forward or reverse motion of wheels 18 may be transferred from axles 34 to frame 32 by way of bearing assemblies 38 and traction rods 46. From frame 32, the tractive forces may move inward through bearing 28 to pivot shaft 26 within base platform 16. Reactionary tractive forces may then travel in reverse direction through these same components back to wheels 18.

As locomotive 10 travels along associated tracks, transverse irregularities in the tracks and/or a curving track trajectory may exert transverse forces on wheels 18. These transverse forces may travel from wheels 18 through axles 34 and bearing assemblies 38 to frame 32 by way of protrusions 48. The path used to transfer transverse forces from frame 32 to base platform 16 of car body 12 may be the same path taken by tractive forces described above. Reactionary transverse forces may then travel in reverse direction through these same components back to wheels 18.

Car body 12 and all components between car body 12 and wheels 18 may exert vertical forces on wheels 18 that can change based on vertical irregularities and/or vertical trajectory changes of the associated tracks. Wheels 18 may support these vertical forces by way of axles 34, bearing assemblies 38, springs 40, and frame 32. In particular, wheels 18 may transfer vertical forces with bearing assemblies 38 via axles 34. Springs 40, resting atop bearing assemblies 38, may transfer the vertical forces to frame 32. Frame 32 may transfer vertical forces with base platform 16 via RMs 30.

Because springs 40 pass through frame 32 (e.g., through side members 56, 74, and 76), the profile may be simple and the center of gravity kept low. In addition, because tubular protrusions 86 may be added to the upper surface of side members 74, 76 to house springs 40, the length of springs 40 may not be limited by the height of side members 74, 76.

It will be apparent to those skilled in the art that various modifications and variations can be made to the disclosed railway truck and frame without departing from the scope of the disclosure. Other embodiments of the railway truck will be apparent to those skilled in the art from consideration of the specification and practice of the railway truck and frame disclosed herein. It is intended that the specification and examples be considered as exemplary only, with a true scope of the disclosure being indicated by the following claims and their equivalents.

What is claimed is:

1. A frame for a railway truck having a plurality of support springs, the frame comprising:

a bottom section having a plurality of first openings configured to receive the plurality of support springs;

a middle section welded to the bottom section, the middle section includes:

a plurality of outer walls;

a plurality of webs welded between the plurality of outer walls; and a cross-tube located at a trailing end of the frame; and a top section spaced apart from the bottom section and welded to the middle section, the top section having:

a plurality of second openings configured to register with the plurality of first openings in the bottom section; and a plurality of protrusions extending away from the middle section at the plurality of second openings to enclose exposed ends of the plurality of support springs.

2. The frame of claim 1, wherein the bottom section is generally planar.

3. The frame of claim 2, wherein the bottom section includes:

two elongated side members; and at least one transom connected between the two elongated side members, wherein the plurality of first openings are formed within the two elongated side members.

4. The frame of claim 3, wherein each of the plurality of first openings are elongated in a length direction of the elongated side members and configured to receive two of the plurality of support springs.

5. The frame of claim 4, wherein the each of the plurality of second openings is circular and configured to receive a single one of the plurality of support springs.

6. The frame of claim 4, wherein:

the plurality of support springs are axle-mounted; and the plurality of first and second openings are formed at locations corresponding to opposing sides of axles that are connectable to the frame.

7. The frame of claim 3, wherein:

the two elongated side members are cut from flat sheet stock; and the at least one transom is a cast component.

8. The frame of claim 7, wherein the at least one transom includes:

a leading transom; and a trailing transom.

9. The frame of claim 1, wherein the plurality of protrusions includes:

a plurality of tubular protrusions; and a plurality of center spring supports.

10. The frame of claim 9, wherein the plurality of center spring supports are located lengthwise between the plurality of tubular protrusions.

11. The frame of claim 1, wherein connection of the middle section between the bottom and top sections forms a plurality of separate hollow enclosures.

12. The frame of claim 1, wherein:

the top section includes:

a plurality of center spring supports;

a plurality of side members that are generally planar along a majority length and curve upwards at their interior ends to connect to the plurality of center spring supports; and at least one transom connecting the plurality of side members;

the plurality of second openings are formed in the plurality of side members; and the plurality of protrusions are welded to upper surfaces of the plurality of side members.

13. The frame of claim 12, wherein:

the railway truck is configured to support a car body; and the frame further includes a plurality of mounting pads connected to an outer surface of the plurality of side members, the plurality of mounting pads configured to receive resilient members that pin to an underside of the car body.

14. The frame of claim 12, further including connection features formed within ends of the plurality of protrusions, the connection features configured to receive motion limiters associated with the plurality of support springs.

15. A frame for a railway truck having a plurality of support springs, comprising:

a generally planar bottom section having a plurality of elongated openings configured to receive the plurality of support springs;

a middle section welded to the generally planar bottom section; and a top section spaced apart from the generally planar bottom section and welded to the middle section, the top section having:

a plurality of circular openings configured to register with the plurality of elongated openings in the generally planar bottom section; and a plurality of protrusions extending away from the middle section at the plurality of circular openings to enclose exposed ends of the plurality of support springs.

16. The frame of claim 15, wherein:

the generally planar bottom section includes:

two elongated side members;

a first leading transom welded between the two elongated side members; and a first trailing transom welded between the two elongated side members, wherein the plurality of elongated openings are formed within the two elongated side members;

the middle section includes:

a plurality of outer walls;

a plurality of webs welded between the plurality of outer walls; and a cross-tube welded at a trailing end of the frame; and the top section includes:

a plurality of center supports;

a plurality of side members that are generally planar along a majority length and curve upwards at their interior ends to connect to the plurality of center spring supports;

a second leading transom welded between the plurality of side members; and a second trailing transom welded between the plurality of side members, wherein:

the plurality of circular openings are formed in the plurality of side members; and the plurality of protrusions are welded to upper surfaces of the plurality of side members.

17. The frame of claim 16, wherein:

the two elongated side members, the plurality of outer walls, the plurality of webs, and the plurality of side members are all fabricated from flat sheet stock; and the first and second leading and trailing transoms are cast components.

18. A railway truck, comprising:

a plurality of axles;

a plurality of wheels connected to ends of the plurality of axles;

a plurality of traction motors configured to drive the plurality of wheels;

a bearing assembly located at each end of each of the plurality of axles;

two support springs supported by each bearing assembly; and a frame spaced apart from the plurality of axles by the support springs and configured to support the plurality of traction motors, the frame including:

a bottom section having two elongated and generally planar side members with elongated openings each configured to receive the two support springs at each of the plurality of axles;

a middle section welded on top of the bottom section; and a top section welded on top of the middle section to form a plurality of hollow enclosures within the middle section, the top section having:

a plurality of side members with a plurality of circular openings configured to register with the elongated openings and each configured to receive one of the two support springs; and a plurality of protrusions welded to upper surfaces of the plurality of side members and configured to enclose the two support springs.

* * * * *